US005501624A

United States Patent [19]

Matsumoto et al.

[11] Patent Number: 5,501,624

[45] Date of Patent: Mar. 26, 1996

[54] OUTBOARD MOTOR COOLING ARRANGEMENT

[75] Inventors: Masahiro Matsumoto; Kazunobu Nozue, both of Hamamatsu, Japan

[73] Assignee: Sanshin Kogyo Kabushiki Kaisha, Hamamatsu, Japan

[21] Appl. No.: 505,808

[22] Filed: Jul. 21, 1995

[30] Foreign Application Priority Data

Jul. 25, 1994 [JP] Japan ..... 6-172434

[51] Int. Cl.[6] ..... B63H 5/12

[52] U.S. Cl. ..... 440/88; 440/89

[58] Field of Search ..... 440/88, 89, 76, 440/78, 900

[56] References Cited

U.S. PATENT DOCUMENTS

| | | | |
|---|---|---|---|
| 4,371,351 | 2/1983 | Tousey | 440/88 |
| 4,983,135 | 1/1991 | Boda et al. | 440/88 |
| 5,340,345 | 8/1994 | Brodbeck et al. | 440/88 |

*Primary Examiner*—Jesus D. Sotelo

*Attorney, Agent, or Firm*—Knobbe, Martens, Olson & Bear

[57] ABSTRACT

A number of embodiments of flushing arrangements for the lower unit of a marine propulsion device that embodies an underwater exhaust gas discharge. Flushing water is delivered to the outer surface of the portion of the outer casing that is above the water level and that is in direct heat exchanging contact with the exhaust gases for cooling the surface and flushing possible deposits therefrom.

24 Claims, 10 Drawing Sheets

OUTBOARD MOTOR COOLING ARRANGEMENT

BACKGROUND OF THE INVENTION

This invention relates to an outboard motor cooling arrangement and more particularly to an improved cooling system for the lower unit of a marine propulsion device.

As is well known, many forms of outboard marine propulsion devices exhaust the burnt gases from the powering internal combustion engine to the atmosphere through an underwater high-speed exhaust gas discharge. These discharges are positioned in the lower unit and frequently discharge the exhaust gases through the hub of a propeller which forms the propulsion device for the outboard unit. By utilizing such underwater exhaust gas discharge systems it is possible to provide cooling and silencing of the exhaust gases.

Conventionally, the lower unit is formed with an outer casing. There is provided at the lower portion of this outer casing an exhaust gas chamber to which the exhaust gases are delivered through an exhaust system. It is from this chamber that the exhaust gases exit through the underwater exhaust gas discharge. Frequently, the exhaust system that delivers the exhaust gases to this chamber is encircled at least partially by a cooling jacket through which water which has passed through the cooling system of the engine is delivered. In this way excessive heat transfer to the lower unit outer casing is avoided.

However, at least a portion of the exhaust cavity formed in the lower unit is in direct contact with a portion of the outer casing and is not otherwise cooled. This portion of the outer casing is frequently positioned above the water level under normal high-speed operation. However, water does come into contact with this area during operation of the watercraft, as should be obvious.

Thus, a condition exists where there is a highly heated portion of the lower casing in close proximity to the water level. When the water contacts this heated portion, it will be vaporized, and thus leaves deposits on the lower unit casing. When operating in marine environments, this deposit is primarily salt, and thus provides not only problems with corrosion, but results in an unsightly appearance.

It is, therefore, a principal object of this invention to provide an improved arrangement for the exhaust system of such lower units.

It is another object of this invention to provide an arrangement wherein the outer casing of the lower unit is maintained at a low enough temperature that deposits cannot be formed thereon.

It is a further object of this invention to provide an improved arrangement for cooling the lower unit outer casing of a marine propulsion unit through which the exhaust gases pass.

SUMMARY OF THE INVENTION

This invention is adapted to be embodied in an exhaust arrangement for the lower unit of a marine propulsion device having a lower casing forming at least in part an underwater exhaust gas discharge for underwater discharge of exhaust gases from a propelling internal combustion engine. The lower unit casing defines an exhaust cavity which communicates with the underwater exhaust gas discharge. An exhaust conduit extends within the lower casing and terminates in the exhaust cavity at a point above the level of water under at least some running conditions of the marine propulsion device. Means are provided for delivering a flushing stream of cooling water to the outer surface of at least a portion of the lower casing which encloses the exhaust cavity from a point above the level of water.

DETAILED DESCRIPTION OF THE PREFERRED EMBODIMENTS OF THE INVENTION

Figure 1:
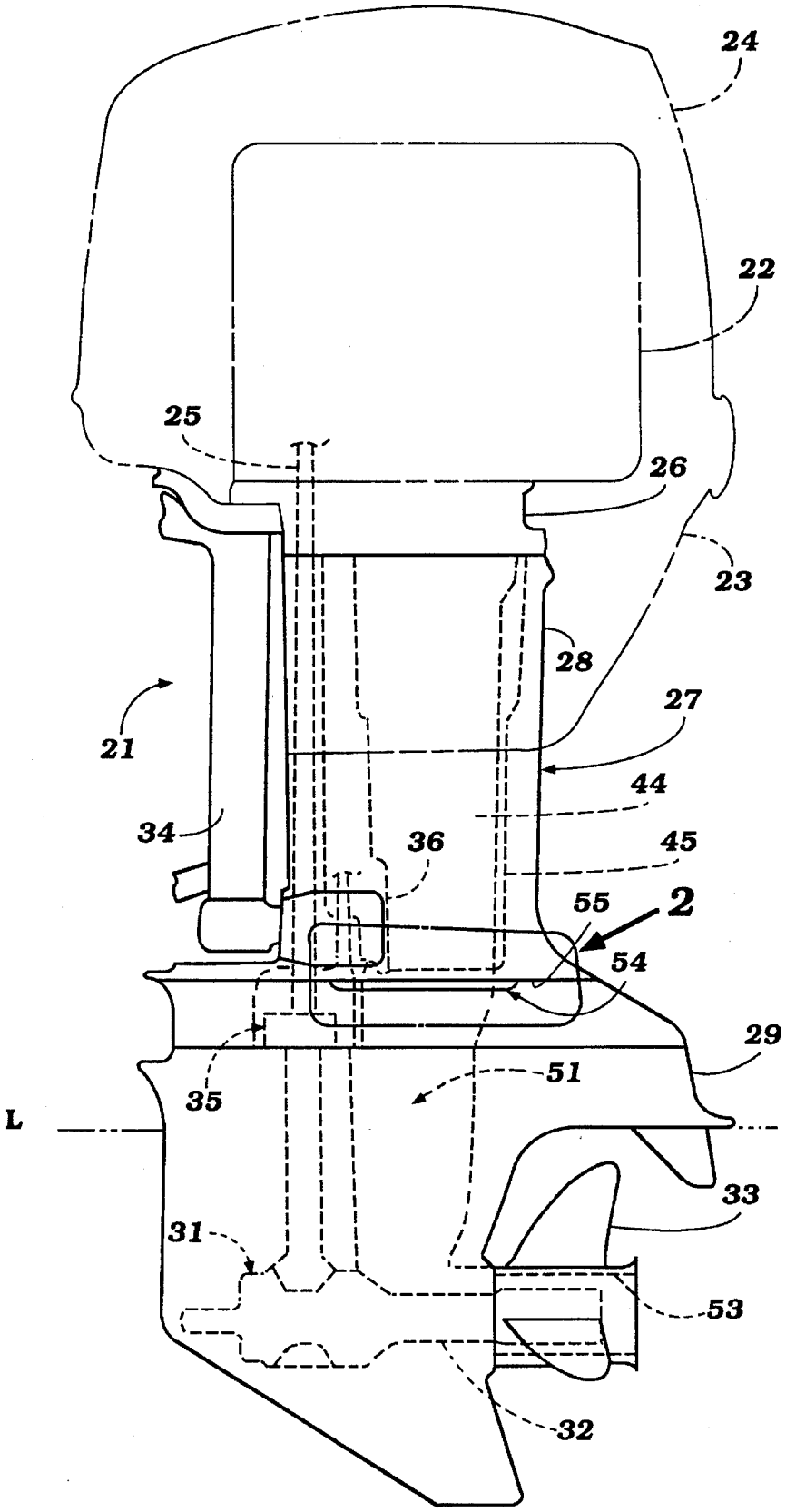
FIG. 1 is a side elevational view of an outboard motor constructed in accordance with a first embodiment of the invention, with a portion of the outboard motor being shown in phantom.

Referring now in detail to the drawings and initially to FIG. 1, an outboard motor constructed in accordance with an embodiment of the invention is identified generally by the reference numeral 21. The invention is described in conjunction with an outboard motor because such outboard motors are a form of outboard marine propulsion unit that embodies an exhaust system wherein the exhaust gases are, at least under some running conditions, delivered back to the atmosphere through an underwater exhaust gas discharge. This exhaust gas discharge is formed in the lower unit. It is to be understood, however, that the invention may be utilized with other types of marine outboard drives having such exhaust systems, such as the outboard drive unit of an inboard/outboard drive.

The outboard motor 21 is comprised of a power head that consists of a powering internal combustion engine, shown in phantom and indicated generally by the reference numeral 22. The engine 22 may be of any known type. Since the engine per se forms no part of the invention, it has been shown in phantom. The power head is completed by a protective cowling that is comprised of a lower tray portion 23 and an upper main cowling portion 24. The main cowling portion 24 is detachably connected to the tray 23 in a known manner.

As is typical with outboard motor practice, the engine 22 is mounted in the power head so that its output shaft, a crankshaft, rotates about a vertically extending axis. This facilitates connection to a drive shaft 25, which also rotates about a coincident vertically extending axis and which depends downwardly from the engine 22 through an exhaust guide plate 24 and into a drive shaft housing, indicated generally by the reference numeral 27, and consisting of an outer housing casing 28.

At its lower end, the drive shaft housing outer casing 28 is connected to a lower unit outer casing 29 and into which the drive shaft 25 extends. Within this lower unit 29 there is provided a conventional bevel gear forward/neutral/reverse transmission 31 which is driven by the drive shaft 25 in a known manner. This bevel gear transmission 31 drives a propeller shaft 32 to which a propeller 33 is affixed for propelling the watercraft in a known manner.

The drive shaft housing 27 is connected to a steering shaft by upper and lower brackets and which steering shaft is rotatably journaled within a swivel bracket 34 for steering motion about a vertically extending axis. The swivel bracket 34 is, in turn, pivotally connected to a clamping bracket (not shown) for tilt and trim motion of the outboard motor 21, as is also well known in the art.

The engine 22 is water cooled. A water pump, indicated generally by the reference numeral 35, is mounted at the interface between the lower portion of the drive shaft housing casing 28 and the lower unit 29. This water pump 35 is driven from the drive shaft 25 in a well-known manner. Likewise, it draws water from the body of water in which the watercraft is operating through a water inlet opening formed in the lower unit 29 which is below the normal water level L at which the outboard motor 21 operates when the associated watercraft is in a planing condition. This water is then delivered to the engine cooling jacket, among other things, through a supply conduit 36 that extends upwardly into the power head for connection to the cooling jacket of the engine 22 in a known manner.

Except for the other use of the water pump 35 which will be described, the construction as thus far described may be considered to be conventional. For that reason, further details of the conventional elements of the construction are not believed to be necessary to enable those skilled in the art to practice the invention.

Figure 2:
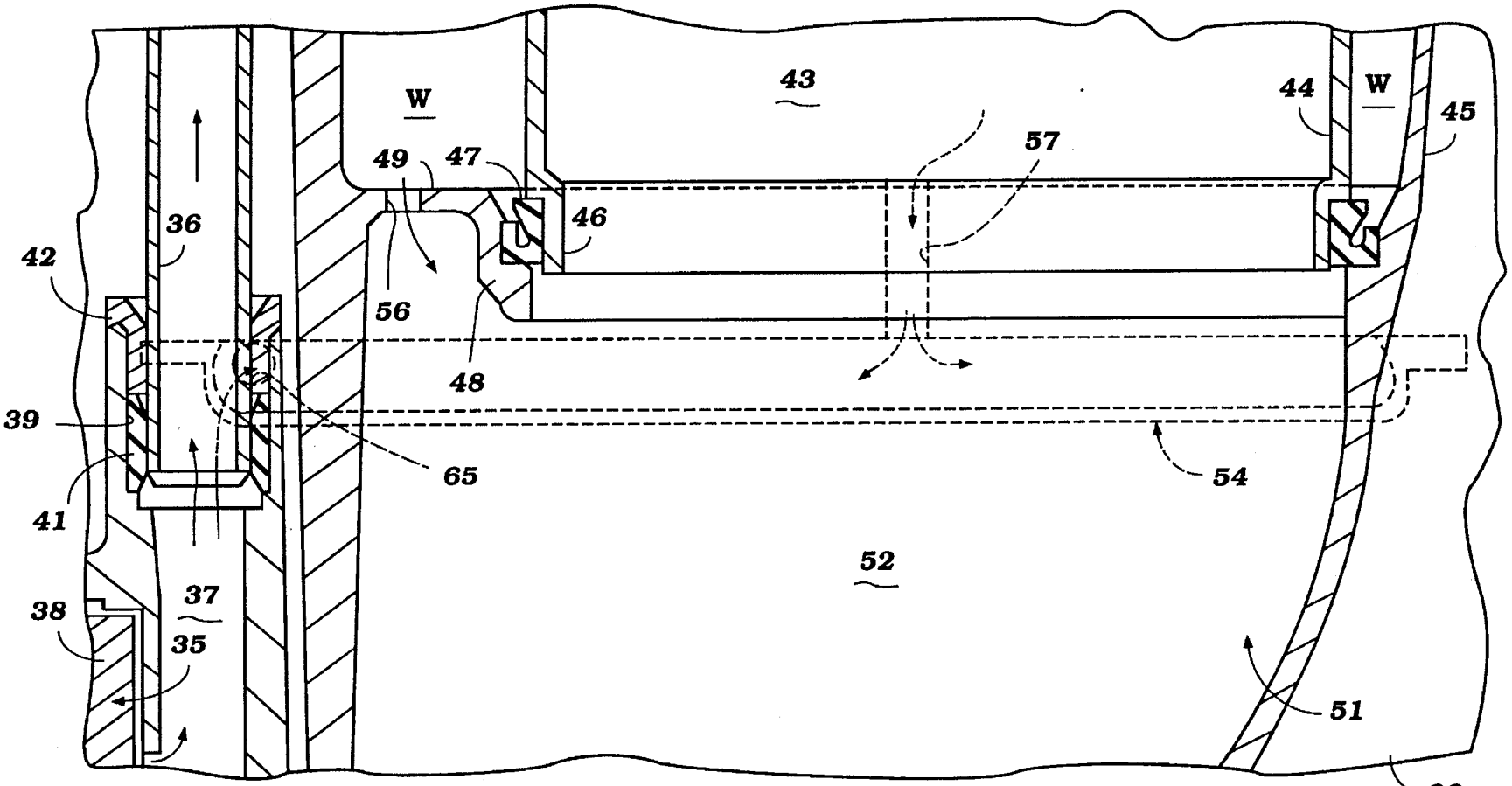
FIG. 2 is an enlarged cross-sectional view of the area encompassed by the closed line 2 in FIG. 1 and taken through the longitudinal center line of the outboard motor.
Figure 3:
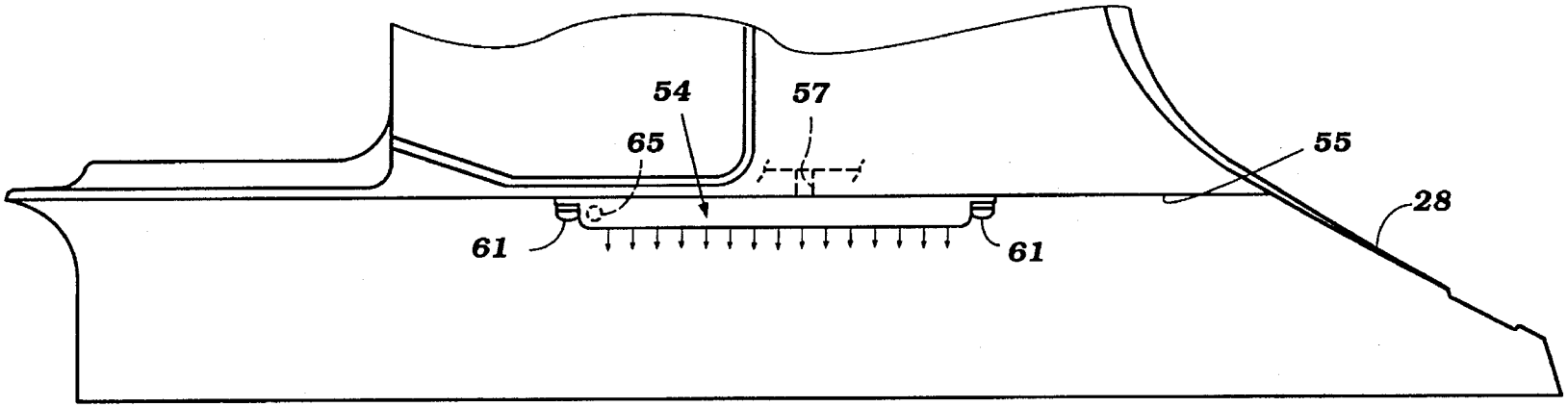
FIG. 3 is an enlarged side elevational view of the interface between the drive shaft housing and lower unit and shows in smaller scale a portion of the area encompassed in FIG. 2.
Figure 4:
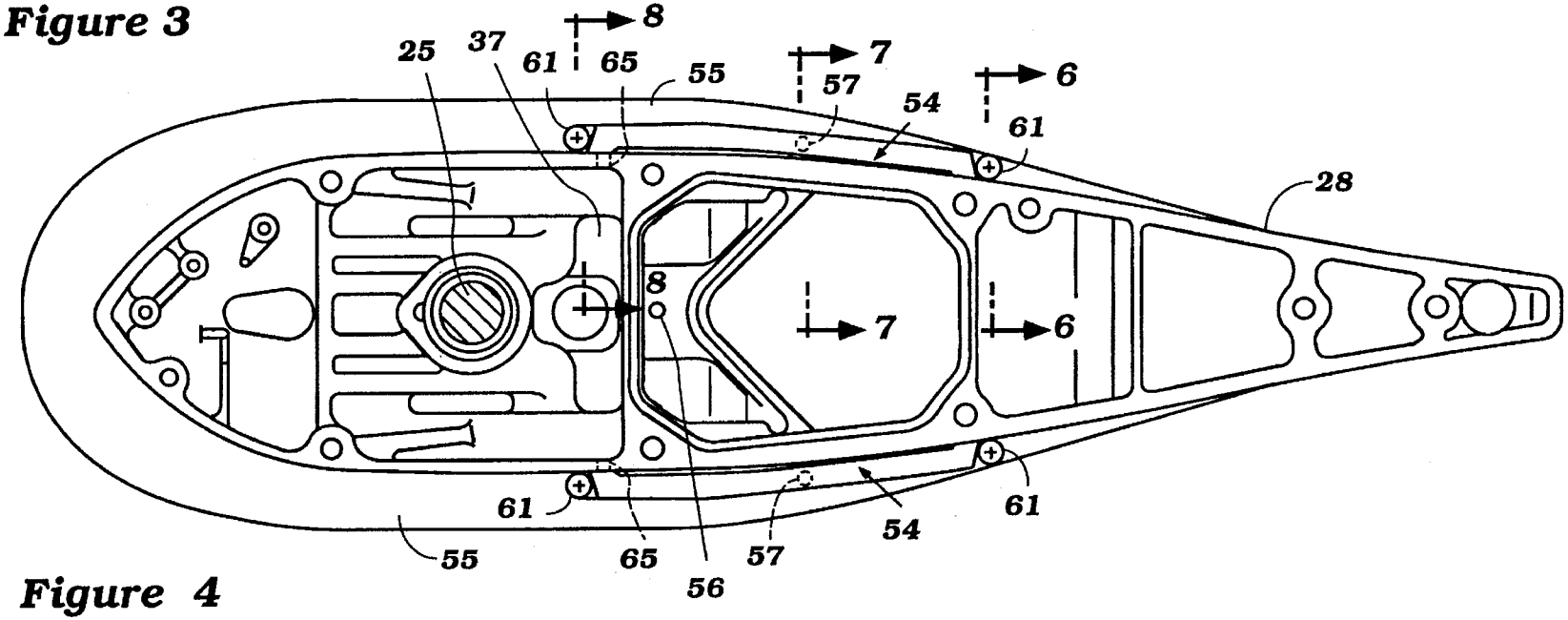
FIG. 4 is a bottom view of the portion of the construction shown in FIG. 3.
Figure 5:
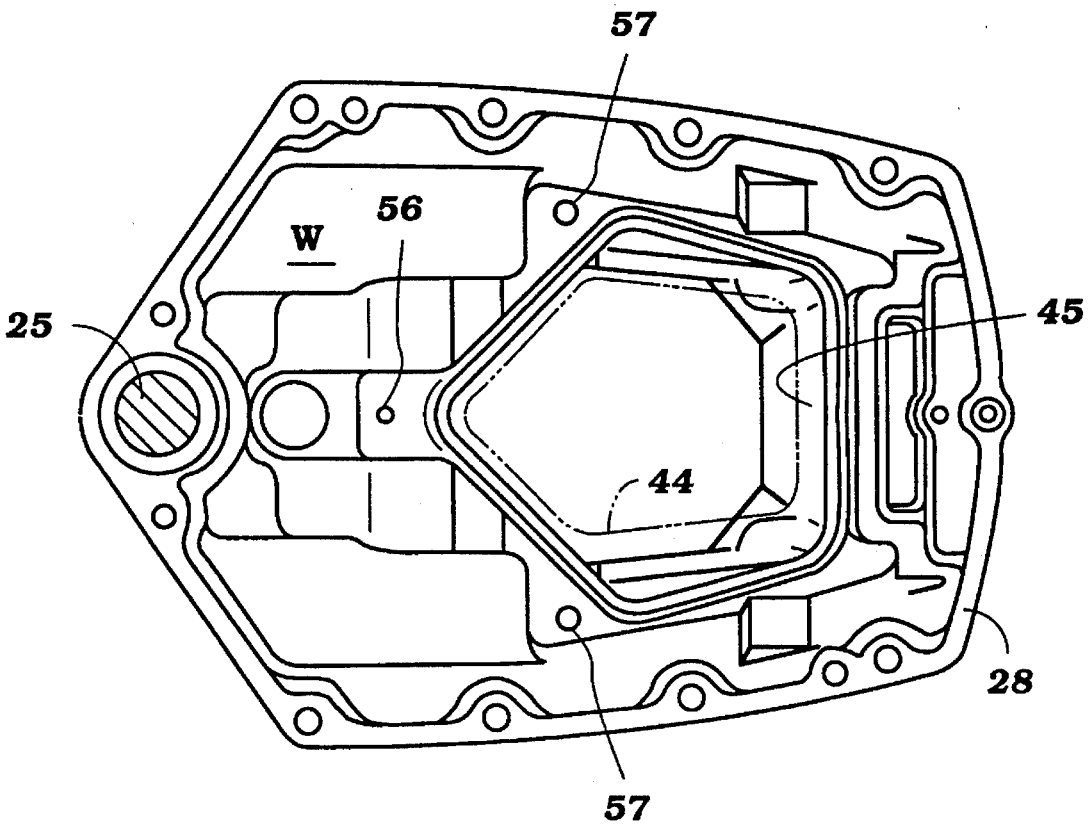
FIG. 5 is a top view of the portion of the construction shown in FIG. 3, but is taken at the upper end of the drive shaft housing.

The connection of the water pump 35 to the supply conduit 36 at its lower end is shown in more detail in FIG. 2. As may be seen, the water pump assembly 35 defines a discharge conduit 37 to which water is delivered by the pumping element 38. The upper end of the conduit 37 is formed with a counter bore 39 in which a sealing grommet 41 and fitting 42 are positioned so as to sealingly engage the lower end of the supply conduit 36 and form a watertight path upwardly to the engine. As will be described later, in accordance with a feature of the invention, some of this water may be diverted for cooling and flushing the outer periphery of the lower part of the drive shaft housing casing 28 and the lower unit casing 29.

As is typical with outboard motor practice, the engine 22 has its exhaust system arranged so that the exhaust gases are delivered through a manifold formed therein to an exhaust gas outlet which communicates with an exhaust passage in the guide plate 26. An exhaust pipe (not shown) is fixed to the underside of the guide plate 26 and terminates in an expansion chamber volume 43 formed by an inner shell 44 that is mounted within the drive shaft housing casing 28 in an appropriate manner and part of which mounting will be described by particular reference to FIG. 2.

The expansion chamber outer casing 44 is encircled by a further inner shell portion 45 of the drive shaft housing casing 28. This forms a water jacket W around the outer surface of the expansion chamber 43, and specifically its casing 44. A flange 46 on the lower end of the expansion chamber shell 44 receives an elastic seal 47 which is received in a depending flange 48 formed in a horizontal wall 49 which defines the lower end of the water jacket W. Cooling water from the engine cooling jacket is delivered through the guide plate 26 to the water jacket W for cooling and silencing of the exhaust gases.

The exhaust gases which have been silenced by their expansion and cooling in the expansion chamber 44 are then delivered to an underwater exhaust gas discharge system, indicated generally by the reference numeral 51. The exhaust gas discharge system 51 includes an exhaust cavity 52 formed in the lower part of the drive shaft housing casing 28 and the upper portion of the lower unit casing 29. This exhaust gas cavity 52 communicates with a through-the-hub underwater exhaust gas discharge, indicated by the reference numeral 53, that is formed in the hub of the propeller 33 in a known manner.

When operating under high-speed conditions and with the water level at the point L shown in FIG. 1, it should be apparent that some water will be present in the exhaust gas cavity 52 aforedescribed. However, this water will not be above the level L, and hence there is a portion of the outer surface of the lower unit casing 29 and the lower portion of the drive shaft housing outer casing 48 which are directly contacted by these exhaust gases. The exhaust gases will still obviously be at a relatively high temperature. Hence, water splashing on the exterior portion of these surfaces will boil off, leaving deposits. If the outboard motor 21 is operating in a marine environment, these deposits will include a large amount of salt, which will not only cause an unsightly appearance, but possibly corrosion of the housing elements 28 and 29.

Therefore, and in accordance with an embodiment of the invention, a pair of water manifolds, indicated generally by the reference numeral 54, are affixed to an underside 55 of the portion of the drive shaft housing casing 28 immediately above its connection to the lower unit casing 29. Water is delivered, in a manner to be described, to these water manifolds 54 and is then bled from them over this peripheral surface of the casings 28 and 29 so as to provide a constant stream of flushing and cooling water. This water flow encompasses the entire outer area of the exhaust cavity 52, and thus will ensure that the surfaces that come into contact with the exhaust gases will be cooled enough to avoid the evaporation and deposit problems aforenoted.

Conventionally, the water which fills the water jacket W around the drive shaft housing expansion chamber 43 is dumped into the exhaust chamber 52. However, this direct supply of water is not adequate to solve the problems aforenoted on the exterior surfaces of the casings 28 and 29. Thus, in accordance with this invention, only one weep hole 56 is provided in the wall 49 of the drive shaft housing for delivering water to the exhaust chamber 52. By supplying only a small amount of water in this area, it is possible to ensure that any catalytic bed which may be contained with the expansion chamber 43 is not likely to contact the water. That is, the bulk of the cooling water from the engine is discharged externally through the system now to be described.

The wall 49 on the sides of the exhaust cavity 52 is provided with a pair of relatively large drain holes 57. These drain holes 57 deliver water to the water manifolds 54.

As may be seen best in FIGS. 6-12, each water manifold is comprised of an outwardly extending flange 58 having a pair of openings 59 that receive threaded fasteners 61 for providing a detachable connection to the drive shaft housing underside 55. The water manifolds 54 have a generally open trough shape so that the water delivered thereto can be collected.

Figure 7:
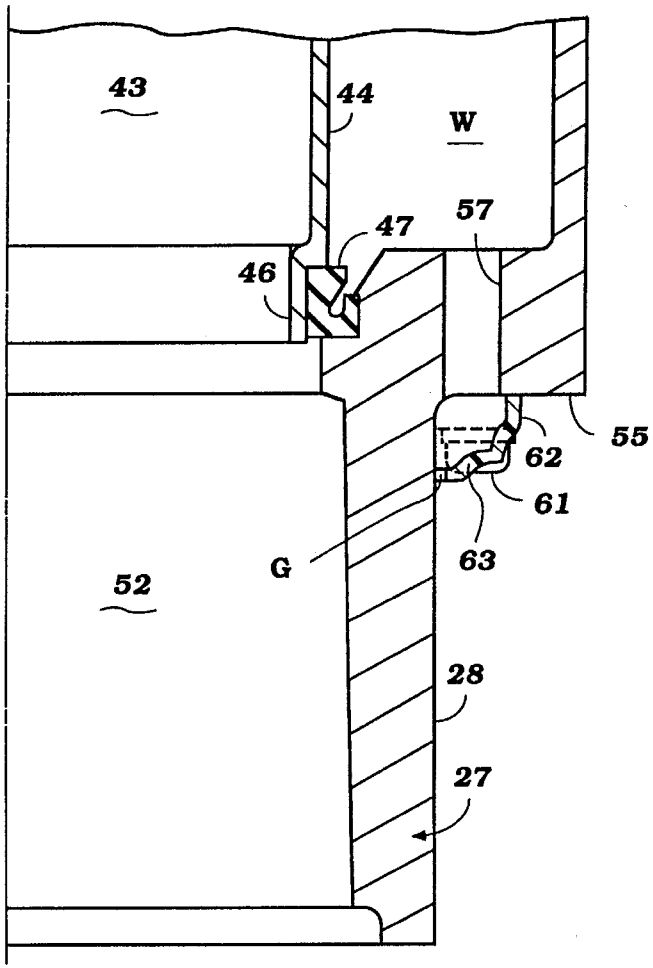
FIG. 7 is a cross-sectional view taken along the line 7—7 of FIG. 4, again showing the unit in its upright rather than inverted condition.
Figure 6:
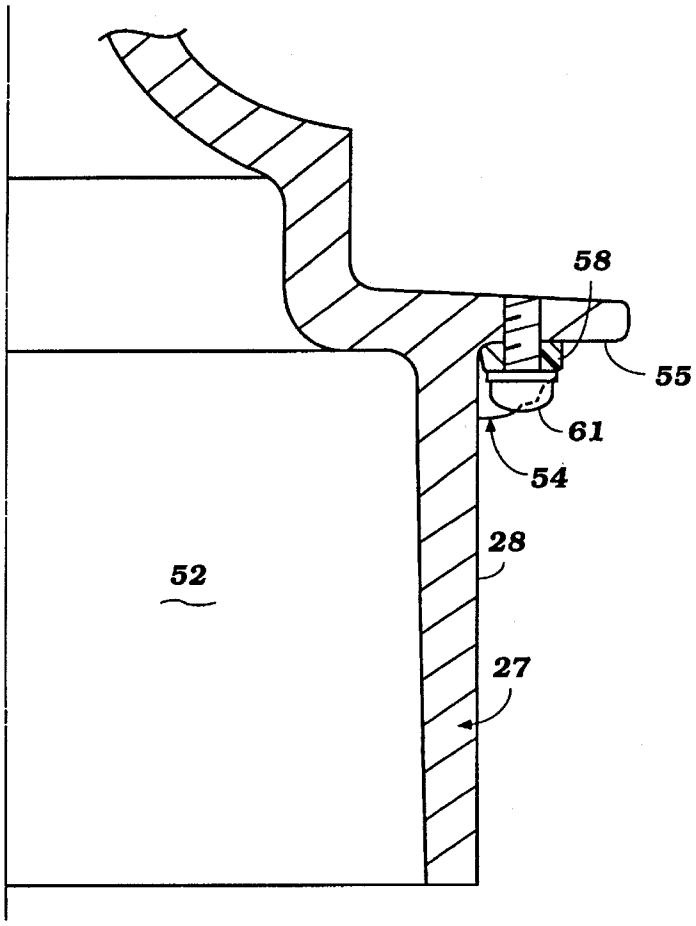
FIG. 6 is an enlarged cross-sectional view taken along the line 6—6 of FIG. 4, but with the element in its upright rather than inverted condition.
Figure 9:
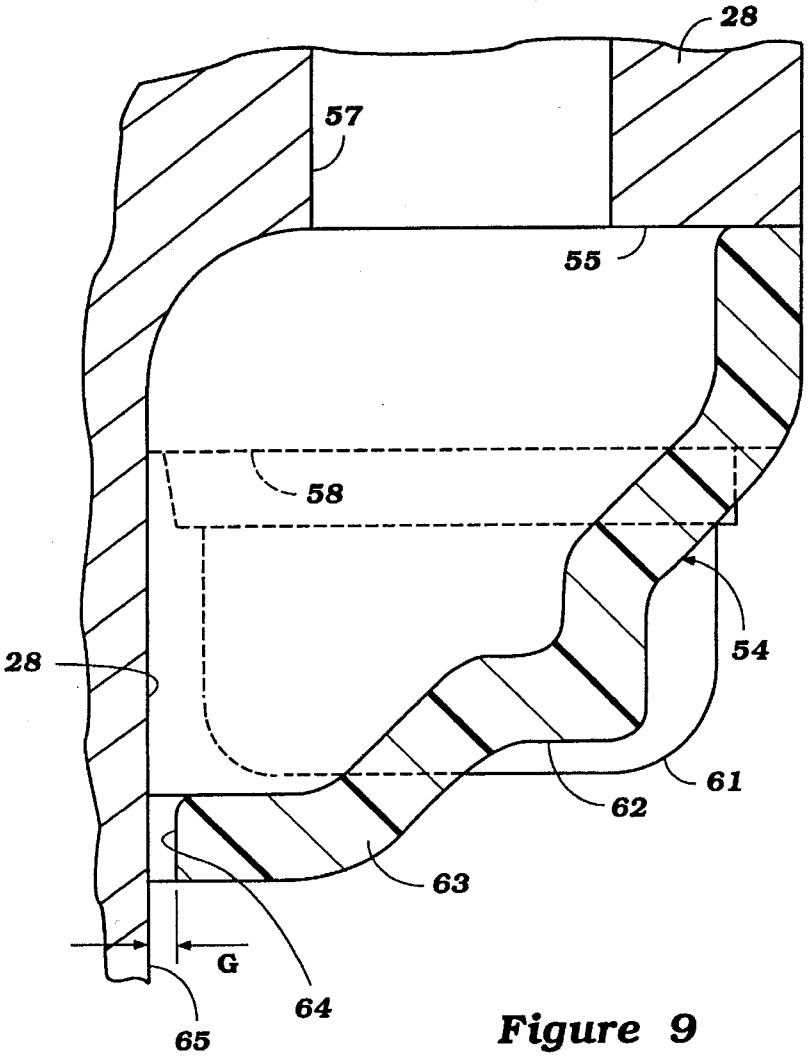
FIG. 9 is an enlarged view of the water manifold arrangement shown in FIG. 7.
Figure 8:
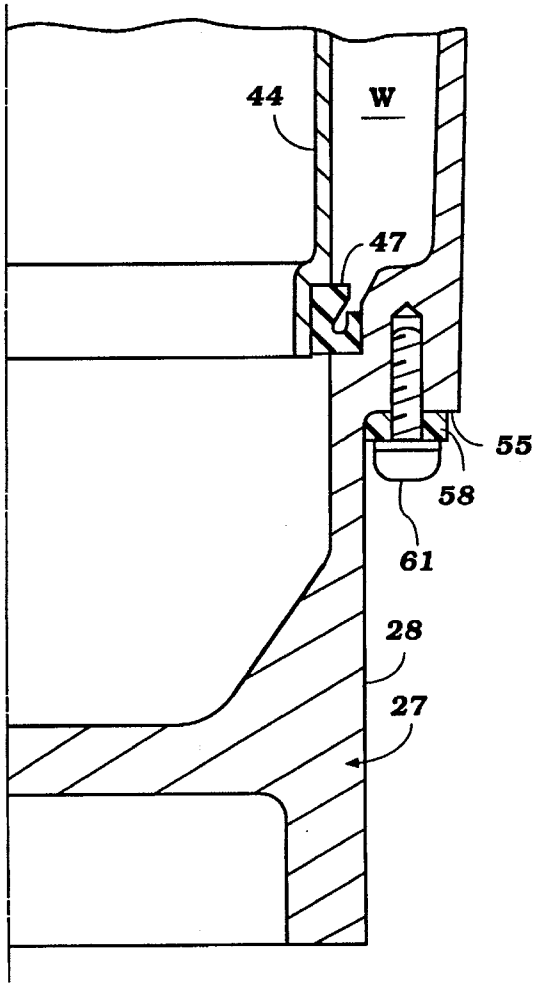
FIG. 8 is a cross-sectional view taken along the line 8—8 of FIG. 4, again showing the unit in its upright rather than inverted condition.
Figure 10:
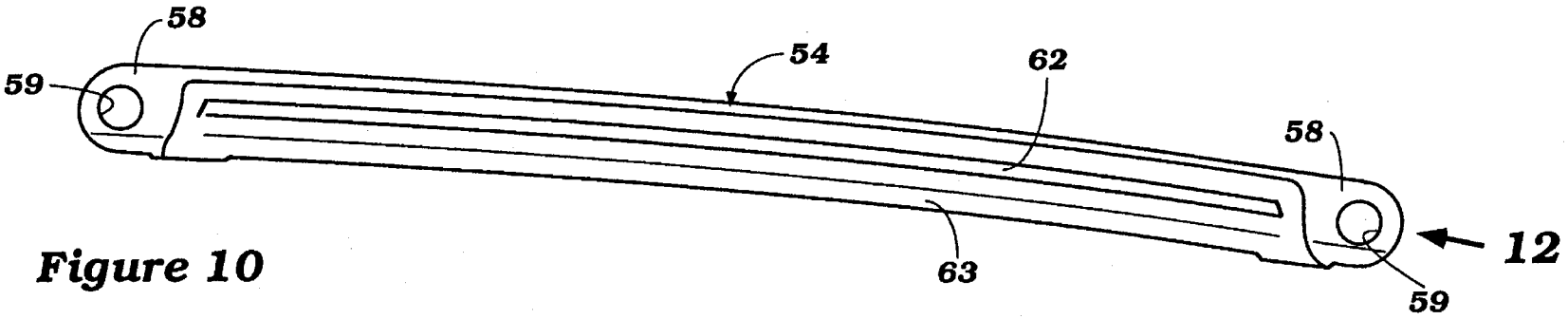
FIG. 10 is a bottom plan view of the water manifold.
Figure 11:
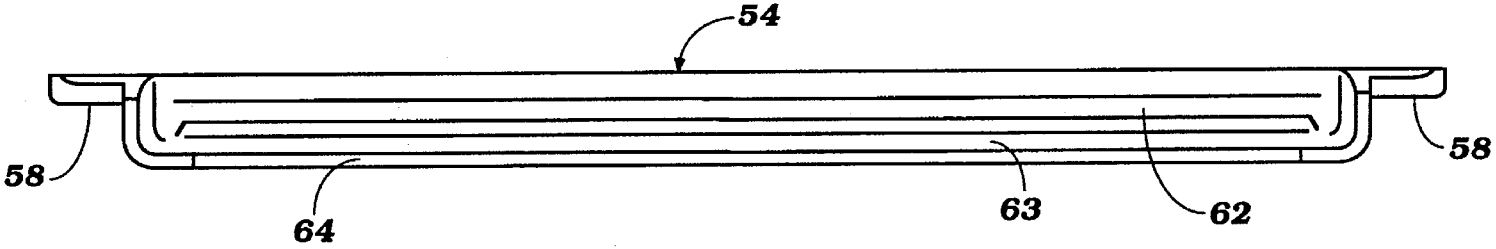
FIG. 11 is a side elevational view of the water manifold, but showing it in its upright condition.
Figure 12:
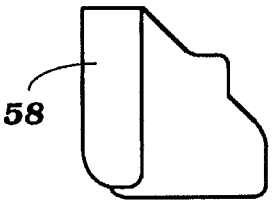
FIG. 12 is a view looking in the direction of the arrow 12 in FIG. 10.

As may be best seen in FIGS. 7 and 9, this shaft is comprised of a generally vertically extending side wall portion 62 that bends and merges into a lower wall 63 which terminates at a peripheral edge 64 that is spaced by a gap G from a drive shaft housing outer surface 65. Hence, the water which is delivered to these manifolds 54 will be discharged through this gap and will flow across the surfaces of the outer housing 28 and 29, bounding the exhaust chamber 52 so as to provide not only good cooling, but also a copious flow of flushing water thereover. Hence, it will be ensured that deposits cannot be formed on the outer housing of the outboard motor 21.

Although the water supply as thus far described may be adequate for cooling and cleaning purposes, it may be desirable to provide additional water for several reasons. The first of these is that the water which has been delivered from the engine cooling jacket will have been heated, and thus will not provide as large a temperature gradient as may be desired. In addition, the volume of water flowing through the engine cooling jacket may be less than desired to provide the cooling and flushing function. Therefore, there is provided a pair of additional cooling flow ports 65 that extend directly from the water pump coolant outlet port 37. These ports 65 extend through the side walls of the drive shaft housing outer casing 28 and communicate directly with the interior of the water manifolds 54. Hence, they will supply not only a large volume of water, but also water that is at a lower temperature than that delivered from the engine cooling jacket.

Figure 13:
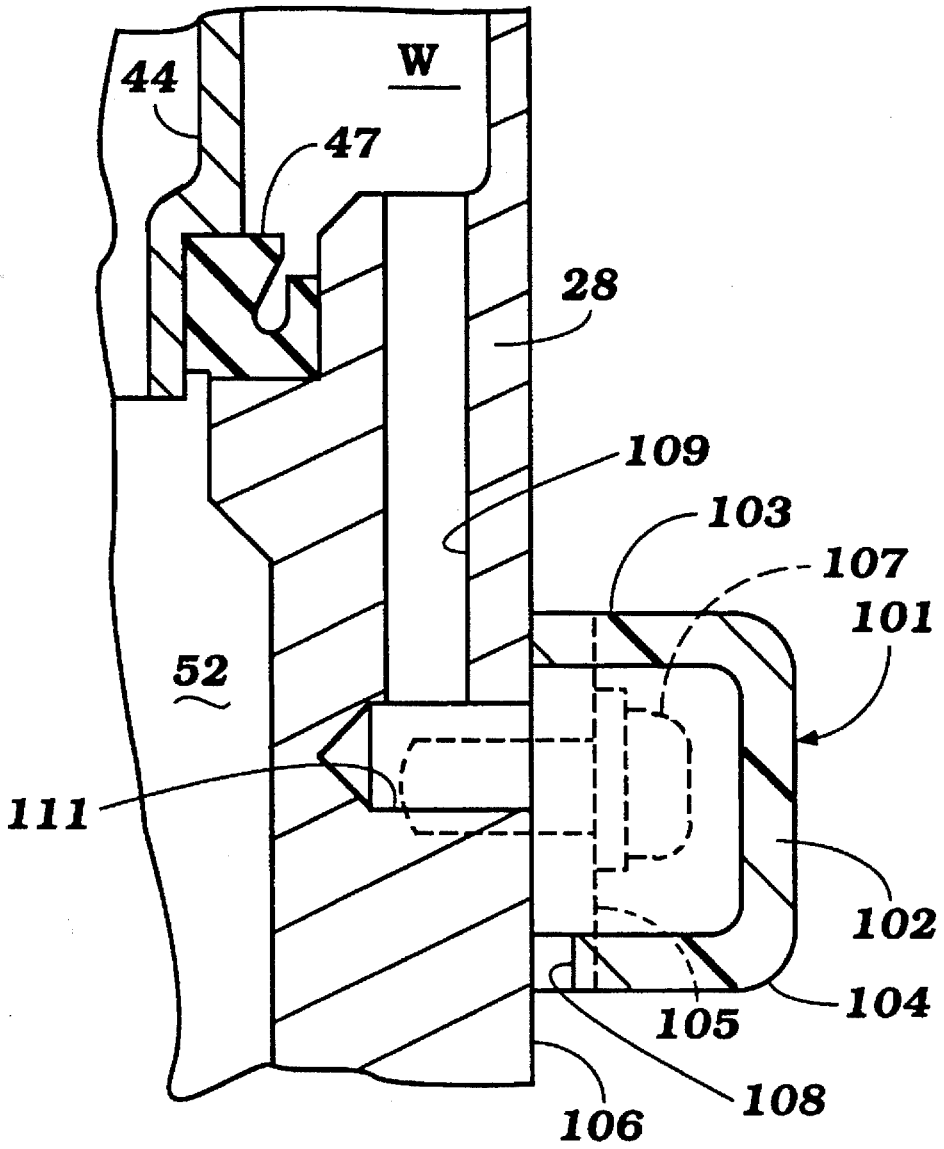
FIG. 13 is an enlarged cross-sectional view, in part similar to FIG. 7, and shows another embodiment of the invention.

In the embodiment as thus far described, the drive shaft housing outer casing 28 has been provided with the horizontally extending downwardly facing surface 55 which extends contiguous to the outer peripheral edges of the portion surrounding the exhaust cavity 52. In some outer housing constructions, such a flange may not exist, and FIG. 13 shows another embodiment that can be utilized with such constructions.

In this embodiment a water manifold, indicated generally by the reference numeral 101, has a generally channel shape formed by a vertically extending leg 102, an upper horizontally extending leg 103, and a lower horizontally extending leg 104. A flange 105 is formed at the ends of the manifold 101 and is affixed to an outer surface area 106 of the drive shaft housing outer casing 28 by threaded fasteners 107. The lower leg 104 terminates at an edge 108 that is spaced from the surface 106 and defines a gap through which water may drain along the outer periphery of the exhaust cavity 52.

One or more vertically drilled passages 109 are formed in the drive shaft housing outer casing 28 at the lower end of the water jacket W. These are intersected by horizontally extending drillings 111, which are covered when the manifolds 101 are placed in position. Hence, water will be delivered to the manifolds 101 from the water jacket W and flow over the surfaces 106 to provide cooling and flushing to preclude deposit accumulation. As with the previously described embodiment, the drive shaft housing casing 28 may also be provided with internal passages extending directly from the output side of the water pump 35 to these manifolds 101.

Figure 14:
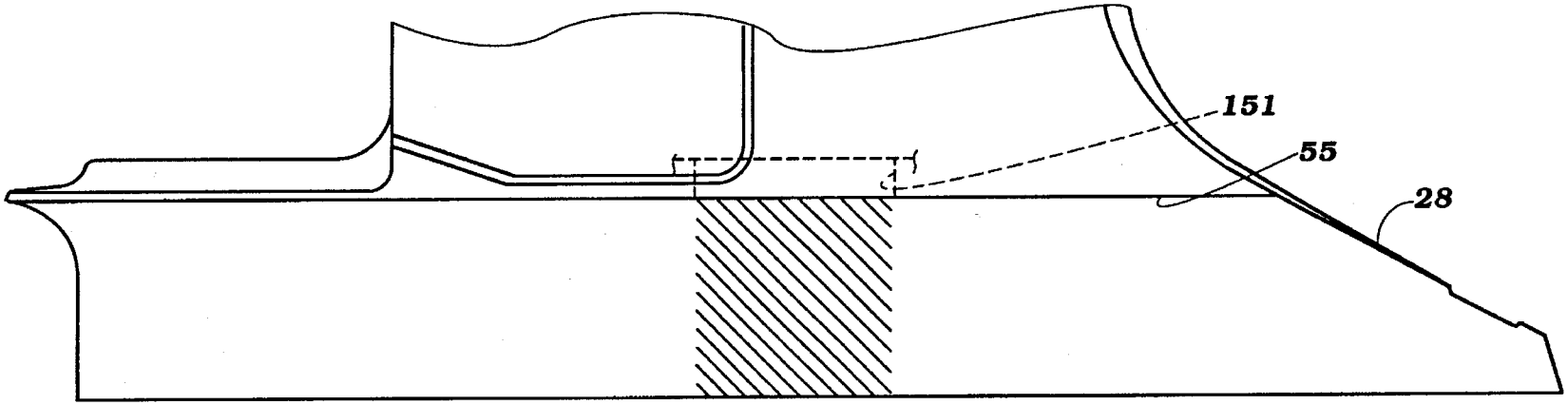
FIG. 14 is a side elevational view, in part similar to FIG. 3, and shows a still further embodiment of the invention.
Figure 15:
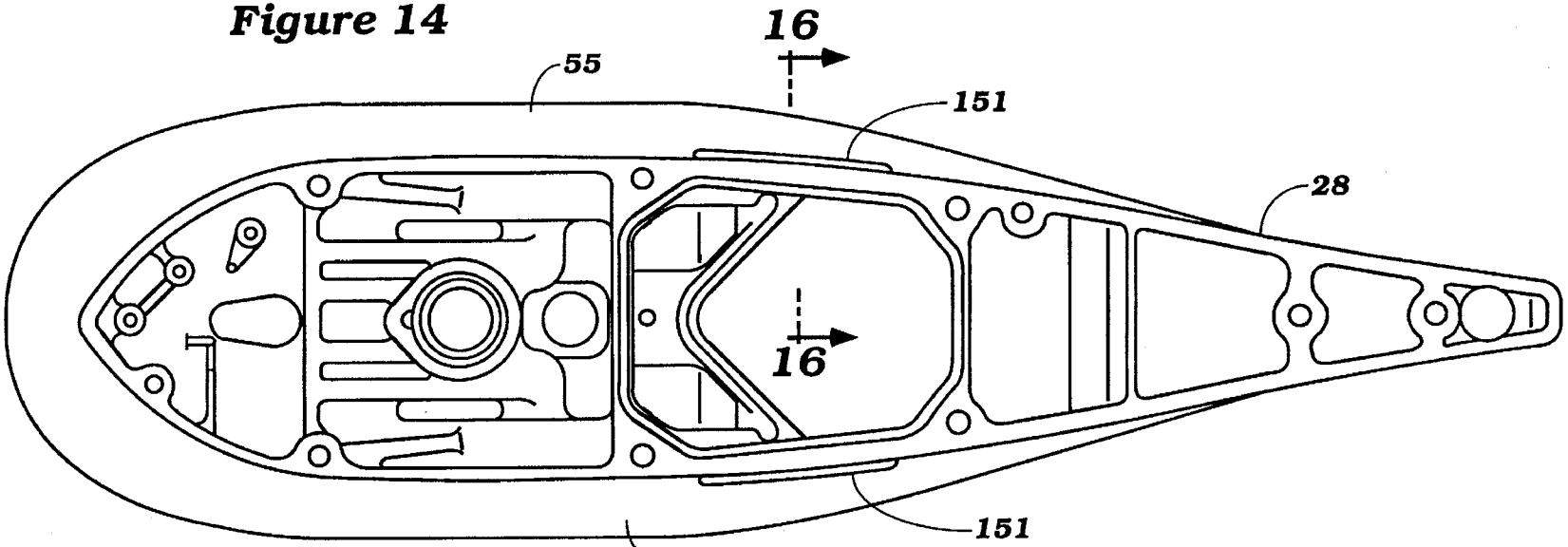
FIG. 15 is a bottom plan view of the embodiment shown in FIG. 14.
Figure 16:
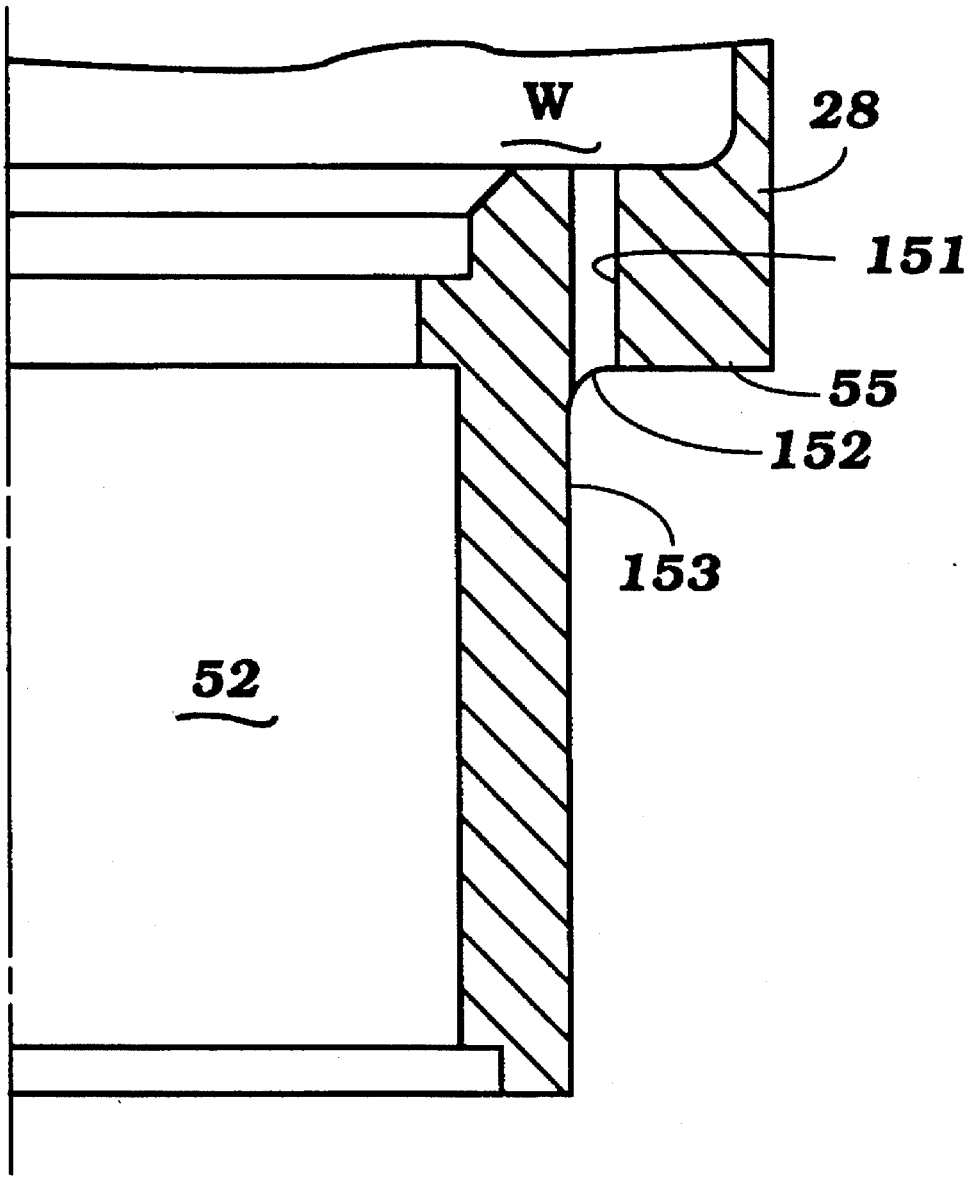
FIG. 16 is an enlarged cross-sectional view taken along the line 16—16 of FIG. 15, but shows the unit in its normal upright condition.

FIGS. 14–16 show another embodiment of the invention wherein there is provided a lower flange on the drive shaft housing casing 28. In this embodiment, however, there is not provided an attached water manifold. Rather, the water jacket W itself is utilized as the water manifold. Because of this similarity to the previously described embodiment, where components of this embodiment are the same as those previously described, they have been identified by the same reference numerals and will be described again only insofar as is necessary to understand the construction and operation of this embodiment.

In this embodiment the lower flange surfaces 55 are provided with slotted openings 151 which extend along a substantial area of the lower unit casing 28, and specifically along the shaded area shown in FIG. 14 where the exhaust chamber 52 is formed. That is, water flows through a gap 152 formed by the opening 151 in the flange 55 directly over the surface 153 of the drive shaft housing outer casing 28 that surrounds the exhaust cavity 52. This water will also flow downwardly over the corresponding portion of the lower unit to cool and cleanse it. As with the previously described embodiments, water may also be delivered to the slotted openings 151 directly from the water pump 35 through appropriate internal passages formed in the drive shaft housing outer casing 28.

It should be readily apparent from the foregoing description that the described embodiments of the invention provide very effective cooling for the portion of the drive shaft housing and lower unit outer casing that does not have an internal water jacket. However, this arrangement can also be used to cool the outer surfaces of portions which also have internal cooling jackets to provide flushing and cleaning action to reduce the likelihood of deposits accumulating and unsightly appearance resulting. Of course, the foregoing description is that of preferred embodiments of the invention, and various changes and modifications may be made without departing from the spirit and scope of the invention, as defined by the appended claims.

We claim:

1. An exhaust arrangement for the lower unit of a marine propulsion device having a lower casing forming at least in part an underwater exhaust gas discharge for discharge of exhaust gases from a propelling internal combustion engine, said lower casing defining an exhaust cavity, an exhaust conduit extending within said lower casing and terminating in said exhaust cavity at a point above the level of water under at least some running conditions of said marine propulsion device, and means for delivering a flushing stream of cooling water to the outer surface of at least the portion of said lower casing which encloses said exhaust cavity from above the level of water.

2. An exhaust arrangement as in claim 1, further including a water pump for pumping water from the body of water in which the watercraft is operating and driven by the propulsion device for delivering coolant to an associated powering internal combustion engine.

3. An exhaust arrangement as in claim 2, further including means for directly delivering some of the water pumped by the water pump directly to the outer surface of the lower casing without delivery to the propulsion device cooling jacket.

4. An exhaust arrangement as in claim 3, wherein the water pump is disposed contiguous to the outer surface.

5. An exhaust arrangement as in claim 1, further including means providing a cooling water jacket around at least a portion of the exhaust conduit above the exhaust cavity.

6. An exhaust arrangement as in claim 5, wherein at least a portion of the flushing stream of cooling water is delivered from the exhaust conduit cooling jacket.

7. An exhaust arrangement as in claim 6, further including a water pump for pumping water from the body of water in which the watercraft is operating and driven by the propulsion device for delivering coolant to an associated powering internal combustion engine.

8. An exhaust arrangement as in claim 7, further including means for directly delivering some of the water pumped by the water pump directly to the outer surface of the lower casing without delivery to the propulsion device cooling jacket.

9. An exhaust arrangement as in claim 8, wherein the water pump is disposed contiguous to the outer surface.

10. An exhaust arrangement as in claim 1, wherein the means for delivering the flushing stream of cooling water comprises at least one passage formed in the lower casing.

11. An exhaust arrangement as in claim 10, wherein the passage formed in the lower casing communicates with a manifold affixed to the exterior of the lower casing and extending along the exhaust cavity, said water manifold having discharge openings in proximity to the outer casing surface for delivering the flushing stream thereto.

12. An exhaust arrangement as in claim 11, wherein the outer casing defines a horizontally disposed shoulder and wherein the water manifold is affixed to the underside of the shoulder.

13. An exhaust arrangement as in claim 1, wherein the marine propulsion device comprises an outboard motor having an internal combustion engine having an exhaust port that communicates with the exhaust conduit and further including a propulsion device in the lower unit for propelling an associated watercraft.

14. An exhaust arrangement as in claim 13, further including a water pump for pumping water from the body of water in which the watercraft is operating and driven by the propulsion device for delivering coolant to an associated powering internal combustion engine.

15. An exhaust arrangement as in claim 14, further including means for directly delivering some of the water pumped by the water pump directly to the outer surface of the lower casing without delivery to the propulsion device cooling jacket.

16. Art exhaust arrangement as in claim 15, wherein the water pump is disposed contiguous to the outer surface.

17. An exhaust arrangement as in claim 13, further including means providing a cooling water jacket around at least a portion of the exhaust conduit above the exhaust cavity.

18. An exhaust arrangement as in claim 17, wherein at least a portion of the flushing stream of cooling water is delivered from the exhaust conduit cooling jacket.

19. An exhaust arrangement as in claim 18, further including a water pump for pumping water from the body of water in which the watercraft is operating and driven by the propulsion device for delivering coolant to an associated powering internal combustion engine.

20. An exhaust arrangement as in claim 19, further including means for directly delivering some of the water pumped by the water pump directly to the outer surface of the lower casing without delivery to the propulsion device cooling jacket.

21. An exhaust arrangement as in claim 20, wherein the water pump is disposed contiguous to the outer surface.

22. An exhaust arrangement as in claim 13, wherein the means for delivering the flushing stream of cooling water comprises at least one passage formed in the lower casing.

23. An exhaust arrangement as in claim 22, wherein the passage formed in the lower casing communicates with a manifold affixed to the exterior of the lower casing and extending along the exhaust cavity, said water manifold having discharge openings in proximity to the outer casing surface for delivering the flushing stream thereto.

24. An exhaust arrangement as in claim 23, wherein the outer casing defines a horizontally disposed shoulder and wherein the water manifold is affixed to the underside of the shoulder.

* * * * *